US009019112B2

(12) United States Patent
Ratzlaff et al.

(10) Patent No.: US 9,019,112 B2
(45) Date of Patent: Apr. 28, 2015

(54) SYSTEMS AND METHODS FOR OPTIMIZING LOW BATTERY INDICATION IN ALARMS

(71) Applicant: Walter Kidde Portable Equipment, Inc., Mebane, NC (US)

(72) Inventors: Larry R. Ratzlaff, Elgin, IL (US); Stan Burnette, Colorado Springs, CO (US); John Andres, Chapel Hill, NC (US); Bill Chandler, Colorado Springs, CO (US)

(73) Assignee: Walter Kidde Portable Equipment, Inc., Mebane, NC (US)

( * ) Notice: Subject to any disclaimer, the term of this patent is extended or adjusted under 35 U.S.C. 154(b) by 130 days.

(21) Appl. No.: 13/893,928

(22) Filed: May 14, 2013

(65) Prior Publication Data

US 2014/0015682 A1 Jan. 16, 2014

Related U.S. Application Data

(60) Provisional application No. 61/671,605, filed on Jul. 13, 2012.

(51) Int. Cl.

| | |
|---|---|
| ***G08B 21/00*** | (2006.01) |
| ***G08B 21/18*** | (2006.01) |
| ***G08B 17/10*** | (2006.01) |

(52) U.S. Cl.

CPC ..... *G08B 21/182* (2013.01); *G08B 17/10* (2013.01)

(58) Field of Classification Search

USPC ..... 340/636.1, 636.12, 636.19, 628, 641, 340/506, 309.16, 309.7, 286.05

See application file for complete search history.

(56) References Cited

U.S. PATENT DOCUMENTS

| | | | | |
|---|---|---|---|---|
| 5,087,908 | A | 2/1992 | Sanders, Jr. | |
| 5,568,129 | A * | 10/1996 | Sisselman et al. | 340/628 |
| 5,686,885 | A | 11/1997 | Bergman | |
| 5,686,896 | A | 11/1997 | Bergman | |
| 5,886,638 | A | 3/1999 | Tanguay | |
| 5,896,091 | A | 4/1999 | Soderlund | |
| 5,912,626 | A | 6/1999 | Soderlund | |
| 5,933,078 | A | 8/1999 | O'Donnell | |
| 5,966,078 | A | 10/1999 | Tanguay | |
| 5,966,079 | A | 10/1999 | Tanguay | |
| 5,969,600 | A | 10/1999 | Tanguay | |
| 5,990,797 | A * | 11/1999 | Zlotchenko et al. | 340/628 |
| 6,081,197 | A | 6/2000 | Garrick et al. | |
| 6,121,874 | A | 9/2000 | O'Donnell | |
| 6,624,750 | B1 * | 9/2003 | Marman et al. | 340/506 |
| 7,265,678 | B2 * | 9/2007 | Chapman et al. | 340/636.11 |
| 7,508,314 | B2 | 3/2009 | Andres et al. | |
| 7,817,048 | B2 | 10/2010 | Rouse et al. | |

(Continued)

FOREIGN PATENT DOCUMENTS

| | | | |
|---|---|---|---|
| CA | 2346638 | A1 | 4/2000 |
| CA | 2640016 | A1 | 4/2009 |
| CN | 101413992 | A | 4/2009 |
| EP | 1119837 | A1 | 8/2001 |
| EP | 1803105 | A2 | 7/2007 |

(Continued)

*Primary Examiner* — Hung T Nguyen

(74) *Attorney, Agent, or Firm* — Cantor Colburn LLP

(57) ABSTRACT

A method and apparatus for utilizing a timing component to optimize low battery indication in alarm devices. The method and apparatus may set a timing component based on a condition detected by a alarm device. Upon detection of a low battery condition within the alarm device, the alarm device can delay low battery indication, using the timing component, until a time of day with a higher probably of user suitability.

12 Claims, 6 Drawing Sheets

(56) References Cited

U.S. PATENT DOCUMENTS

| | | | | |
|---|---|---|---|---|
| 7,893,825 | B2 | 2/2011 | Gonzales | |
| 7,961,088 | B2 | 6/2011 | Watts et al. | |
| 2005/0151636 | A1* | 7/2005 | Chapman et al. | 340/506 |
| 2006/0176167 | A1 | 8/2006 | Dohrmann | |
| 2008/0117029 | A1 | 5/2008 | Dohrmann | |
| 2009/0102672 | A1 | 4/2009 | Petek et al. | |
| 2009/0212962 | A1 | 8/2009 | Chekal et al. | |
| 2010/0073172 | A1 | 3/2010 | Lax | |
| 2010/0238036 | A1 | 9/2010 | Holcombe | |
| 2011/0095883 | A1 | 4/2011 | Watts et al. | |

FOREIGN PATENT DOCUMENTS

| | | | |
|---|---|---|---|
| EP | 2051221 | A2 | 4/2009 |
| EP | 2363844 | A1 | 9/2011 |
| GB | 2325802 | A | 2/1998 |
| WO | 9001759 | A1 | 2/1990 |
| WO | 9738406 | A1 | 10/1997 |
| WO | 9906980 | | 2/1999 |
| WO | 0021053 | A1 | 4/2000 |
| WO | 2006044750 | A2 | 4/2006 |
| WO | 2010036511 | A1 | 4/2010 |
| WO | 2012031213 | A2 | 3/2012 |

* cited by examiner

SYSTEMS AND METHODS FOR OPTIMIZING LOW BATTERY INDICATION IN ALARMS

This application claims the benefit of Provisional U.S. Patent Application No. 61/671,605, filed Jul. 13, 2012, which is incorporated herein by reference in its entirety.

FIELD

Systems and methods pertaining to optimally initiating low battery indication in battery-powered and battery backup alarms are provided.

DESCRIPTION OF THE PRIOR ART

Alarm devices are used in home and office locations to notify occupants and personnel of problems or conditions at the location. For example, an alarm device can detect the presence of smoke and initiate an audible smoke alarm.

Many such alarm devices are capable of operating with low amounts of power and can be powered, at least in part or as backup, by one or more batteries. Accordingly, even in the event of power loss to a building an alarm device can continue to operate effectively.

Given that many alarm devices run on battery power or utilize a battery backup, it is important that batteries installed in alarm devices are replaced regularly. Accordingly, many alarm devices include functionality for notifying users when the power level of a battery is low. For example, many alarm devices utilize a "low-battery chirp," which can be a regularly-intervaled sound emitted by the alarm device.

However, battery levels may be detected as lower when the ambient temperature around the alarm device is cooler, and cooler ambient temperatures usually occur during the nighttime hours. Accordingly, low battery chirps tend to begin during the nighttime hours.

Low battery chirps during the nighttime hours can be an annoyance to users, especially on alarm devices installed at a residence, and are more likely to be disabled by users without replacing the low battery. Accordingly, there is a need for systems and methods for optimizing low battery indication by delaying low battery indication until the daytime hours.

SUMMARY

According to embodiments, an alarm apparatus is disclosed. In certain embodiments, the apparatus is configured to monitor one or more batteries for power levels. The apparatus is further configured to initiate a wait state for a predetermined period of time upon detection of a low power battery. The apparatus can check the power level of the battery regularly during the wait state. If a low battery power level is not detected during one or more of the wait state power level checks, the alarm can return to normal operation. If a low battery power level remains detected during the wait state checks, the alarm can initiate a low battery indication upon the conclusion of the wait state.

In additional embodiments, the apparatus is configured to regularly record battery levels and determine average battery levels over set periods of time. The apparatus is further configured to estimate a time of day based on the determined average battery levels. If a low power battery is detected, the apparatus is configured to wait until a specified time of day before initiating a low battery indication.

In further embodiments, the apparatus is configured to detect levels of ambient light and compare the levels to previously recorded levels to estimate a time of day. If a low battery power is detected, the apparatus is configured to wait until a specified time of day before initiating a low battery chirp.

In additional embodiments, the apparatus is configured to perform a battery power level check at set intervals. If the battery power level check indicates a low power battery, a low battery indication is not initiated. If the battery power level check indicates a low battery power on a second consecutive check, a low battery indication can be initiated.

In further embodiments, the apparatus is configured to determine that a user-initiated event occurred and set a timer based on the user-initiated event. If a low power battery is detected, the apparatus can determine whether to initiate a low battery indication based on the set timer.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of those embodiments.

DESCRIPTION OF THE EMBODIMENTS

With reference now to the various drawing figures in which identical elements are numbered identically throughout, a description of the embodiments will now be provided.

Figure 1A:
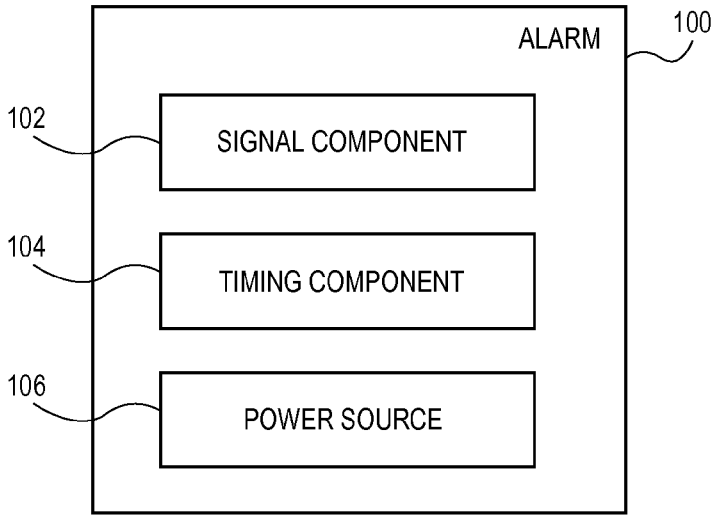
FIG. 1A is a diagram depicting an exemplary alarm apparatus, consistent with certain disclosed embodiments.

FIG. 1A is a diagram depicting an exemplary alarm apparatus, consistent with certain disclosed embodiments. An alarm 100 represents any type of apparatus capable of giving an audible, visual, or other form of signal based on the detection of a condition. Alarm 100 can include various features, including, but not limited to, smoke and/or fire detection, intrusion detection, and harmful substance detection.

In embodiments, alarm 100 can include a signal component 102. Signal component 102 can include functionality such as, but not limited to: audible signaling, using one or more speakers; and visual signaling, using lights and/or displays.

Alarm 100 can further include a timing component 104. Timing component 104 can be connected to signal component 102 and can include one or more clocks or any other type of component capable of estimating the current time or the passage of time.

Further, alarm 100 can include a power source 106. Power source 106 can be connected to signal component 102 and timing component 104. In certain embodiments, power source 106 can be connected to a central power system and can power alarm 100 via the central power system.

Additionally, in other embodiments, power source 106 may not be connected to a central power system, and can include one or more batteries. In further embodiments, power source 106 can draw power from a central power system and from one or more batteries, or can draw power from one or more batteries in the event of a power failure in the central power system.

The one or more batteries can include one or more electrochemical cells capable of converting stored chemical energy into electrical energy. The one or more batteries can be disposable batteries and/or rechargeable batteries of types including, but not limited to, nickel-metal hydride (NiMH), low self-discharge NiMH, nickel-zinc, alkaline, rechargeable alkaline, high-drain alkaline, lithium, and carbon zinc. Additionally, battery sizes of the one or more batteries can include, but are not limited to, AAA cell, AA cell, D cell, nine-volt, and micro cell sizes.

In certain embodiments, alarm 100 can include circuitry and/or functionality for monitoring the power and/or voltage level of one or more batteries utilized by power source 106. Such monitoring can be continuous or at regular intervals. For example, alarm 100 can test and/or record the power and/or the voltage level of the one more batteries every minute, or, as an additional example, alarm 100 can test and/or record the power and/or the voltage level of the one or more batteries every twelve (12) hours. The above time intervals and any time intervals discussed herein are merely for the purpose of illustration and are not intended to be limiting. Battery monitoring can be performed at regular time intervals of any length and such time intervals do not have to be of a constant length.

As an example, alarm 100 can include circuitry for detecting low voltage levels in an attached battery. Alarm 100 can monitor the attached battery and determine if the voltage level per cell is low based on a preset threshold. If the voltage level per cell drops below the preset threshold, alarm 100 can initiate a low battery state.

In some implementations, after the initiation of a low battery state, alarm 100 can initiate a signal using signal component 102. For example, signal component 102 can initiate an audible high-pitched "chirp." However, in certain disclosed embodiments, the low battery chirp may not begin immediately upon detection of the low battery state, as discussed below.

Figure 1B:
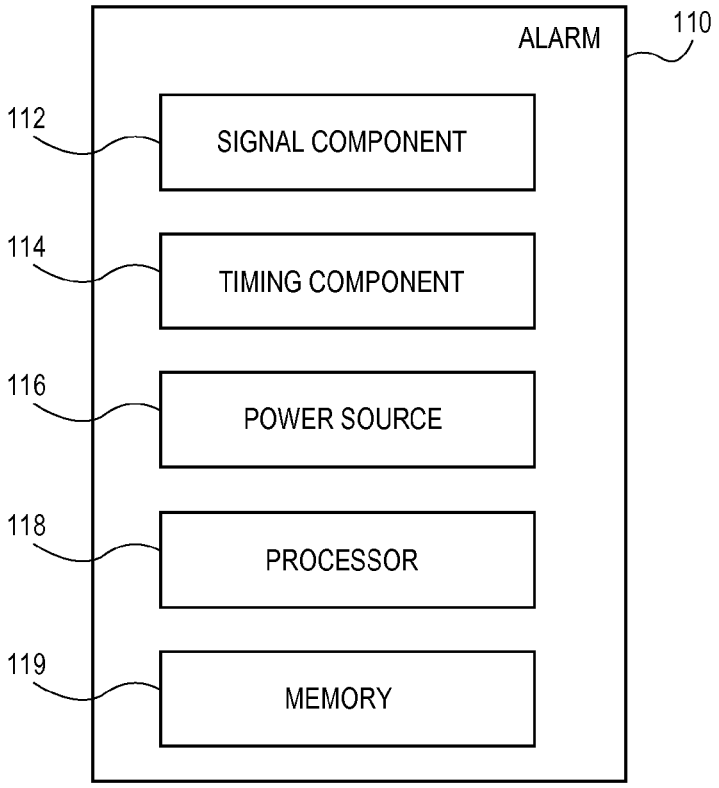
FIG. 1B is a diagram depicting an exemplary alarm apparatus, consistent with certain disclosed embodiments.

FIG. 1B is a diagram depicting an exemplary alarm apparatus, consistent with certain disclosed embodiments. An alarm 110 represents any type of apparatus capable of giving an audible, visual, or other form of signal based on the detection of a condition. Alarm 110 can include various features, such as, but not limited to, smoke and/or fire detection, intrusion detection, and harmful substance detection. Additionally, alarm 110 can include a signal component 112, a timing component 114, and a power source 116. Signal component 112, timing component 114, and power source 116 can be interconnected and include functionality similar to like embodiments discussed above for FIG. 1A.

Alarm 110 can additionally include a processor 118 communicating with a memory 119, such as electronic random access memory, or other forms of transitory or non-transitory computer readable storage mediums. Processor 118 can be interconnected with signal component 112 and power source 116. Further processor 118 can execute control logic and perform data processing to perform the functions and techniques as discussed herein. For example, processor 118 can compare battery levels over periods of time, estimate the current time of day, and set timing component 114 based on the estimated current time of day, as disclosed below. In certain embodiments, processor 118 can include timing component 114, while, in further embodiments, timing component 114 can be connected to and/or operate independently of processor 118.

While FIGS. 1A and 1B illustrate alarms 100 and 110 as standalone apparatuses using hardware or a combination of hardware and software, the components of alarms 100 and 110 can be distributed over a plurality of apparatuses. Further, the disclosed components of alarms 100 and 110 are not intended to be limiting, and alarms 100 and 110 can include any components known to those of skill in the art, consistent with the disclosed embodiments.

Figure 2:
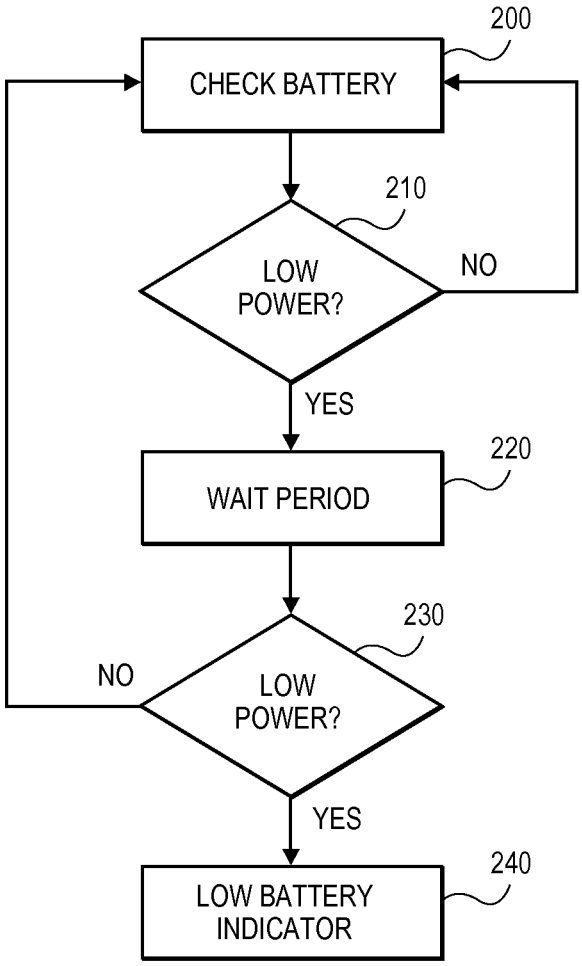
FIG. 2 is a flow diagram depicting an exemplary method for optimizing low battery indication, consistent with certain disclosed embodiments.

Referring to FIG. 2, depicted is a method detailing embodiments as described herein. FIG. 2 depicts steps capable of being performed by an alarm device, such as alarms 100 and 110 depicted in FIGS. 1A and 1B, respectively. It should be appreciated that the method of FIG. 2 is merely exemplary and can include more or fewer functionalities.

The method begins when the alarm device performs a battery check on power and/or voltage levels of one or more batteries attached to the alarm device (200). The alarm device can perform the battery check at regular intervals, such as every hour, which can be monitored using a timing component. If, at 210, the alarm device determines that no batteries are in a low power state, for example, having a voltage per cell above a set threshold, the alarm device can wait until the start of the next interval period before performing the battery check again (200).

If, at 210, the alarm device determines that one or more batteries are in a low power state, for example, having a voltage per cell below a set threshold, the alarm device can initiate a wait period using the timing component (220). As an example, if an initial low battery state is expected to occur during nighttime hours due to lower surrounding temperatures, the alarm device can be set to initiate a wait period of twelve (12) hours. Accordingly, the wait period would end during daytime hours.

During the wait period, the alarm device can perform a series of battery checks at regular intervals on the battery. If, at 230, a predetermined number of battery checks show that the battery's power level has increased to above a threshold power level, the wait period can be canceled and the alarm device can wait until the start of a next interval period before performing another battery check (200).

If, at 230, the predetermined number of checks showing the battery's power level has increased to above the threshold power level has not been met, the alarm device can initiate a low battery indicator (240). For example, the alarm device can initiate a low battery chirp using one or more sound devices.

In additional embodiments, during the series of battery checks at regular intervals, the alarm device can determine that the one or more batteries have a voltage per cell below a second set threshold, and the alarm device can initiate a low battery indicator before the end of the wait period.

Figure 3:
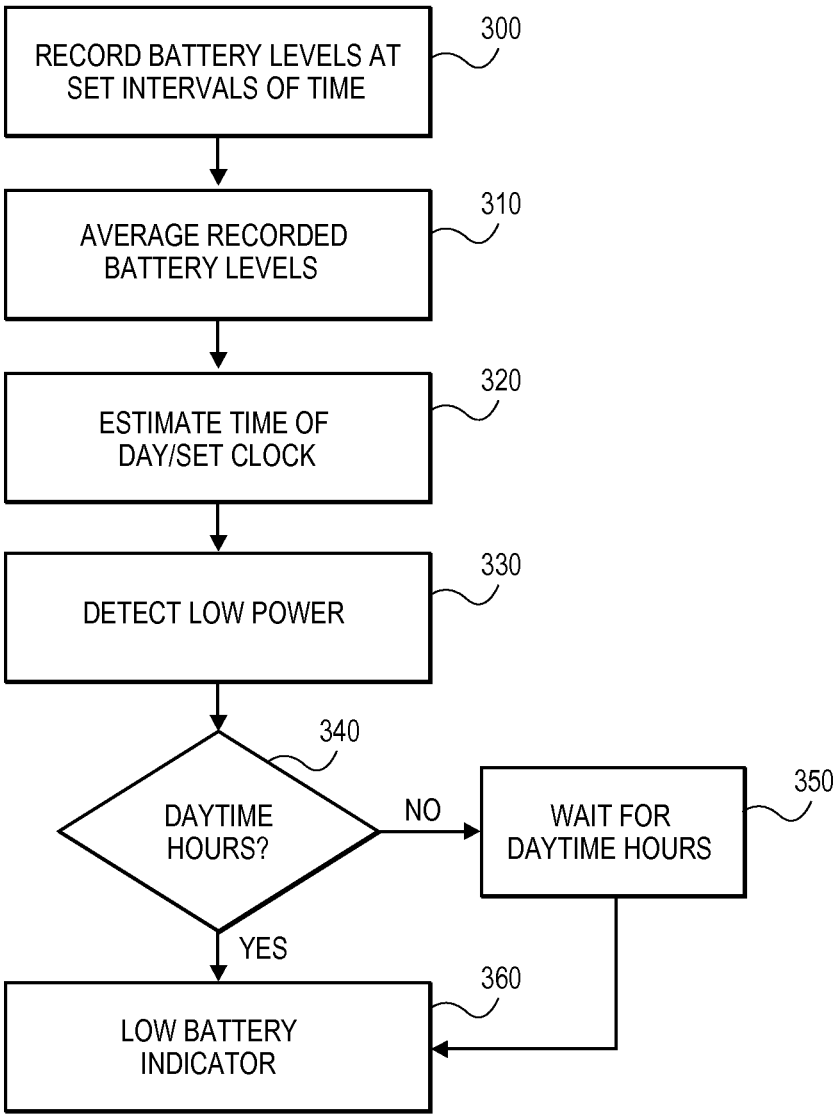
FIG. 3 is a flow diagram depicting an exemplary method for optimizing low battery indication, consistent with certain disclosed embodiments.

Referring to FIG. 3, depicted is a method detailing embodiments as described herein. FIG. 3 depicts steps capable of being performed by an alarm device, such as alarm 110 depicted in FIG. 1B. It should be appreciated that the method of FIG. 3 is merely exemplary and can include more or fewer functionalities.

The method begins when the alarm device records battery power levels of one or more batteries at set intervals of time (300). For example, the alarm device can record battery power levels of the one or more batteries every minute. Based on recorded battery levels, the alarm device can determine average battery levels for set periods of time (310). For example, the alarm device can determine the average battery levels for every hour of a twenty-four (24) hour period.

Based on the average battery levels, the alarm device can estimate a current time of day (320). For example, batteries tend to have the lowest power level at the coldest time of night. Accordingly, if the coldest time of night is preset to be at or around 3:00 AM, the alarm device can be configured to set an hour with a lowest average battery level to be at or around 3:00 AM.

Then, alarm device can detect that a power level of one or more of the one or more batteries has fallen below a certain threshold and initiate a low power state (330). If, at 340, the alarm device determines that an estimated time of day is during the daytime hours, for example, 9:00 AM to 9:00 PM, the alarm device can initiate a low battery indicator, such as a low battery chirp (360). If, at 340, the alarm device determines that the estimated time of day is not during daytime hours, the alarm device can wait until the estimated time of day is during daytime hours (350) before initiating the low battery indicator (360).

In additional embodiments, the method can begin when the alarm records battery power levels of one or more batteries at set intervals of time. For example, the alarm device can record battery power levels of the one or more batteries every hour. Based on the recorded battery levels, the alarm device can determine a running average for set periods of time. For example, the alarm device can determine the running average battery levels for every hour of a twenty-four (24) hour period.

The alarm device can then compare a current sample of the battery power levels of the one or more batteries with the running average battery power levels for the current set period of time, for example, the last twenty-four hours. If the current sample is below the running average, the alarm device can return to an initial state. If the current sample is equal to or above the running average, the alarm device can initiate a low battery indictor.

In further embodiments, the alarm device can compare the current sample of the battery power levels of the one or more batteries not only with the running average battery power level for the current set period of time but additionally to one or more previous set periods of time, such as previous twenty-four (24) hour periods.

Figure 4:
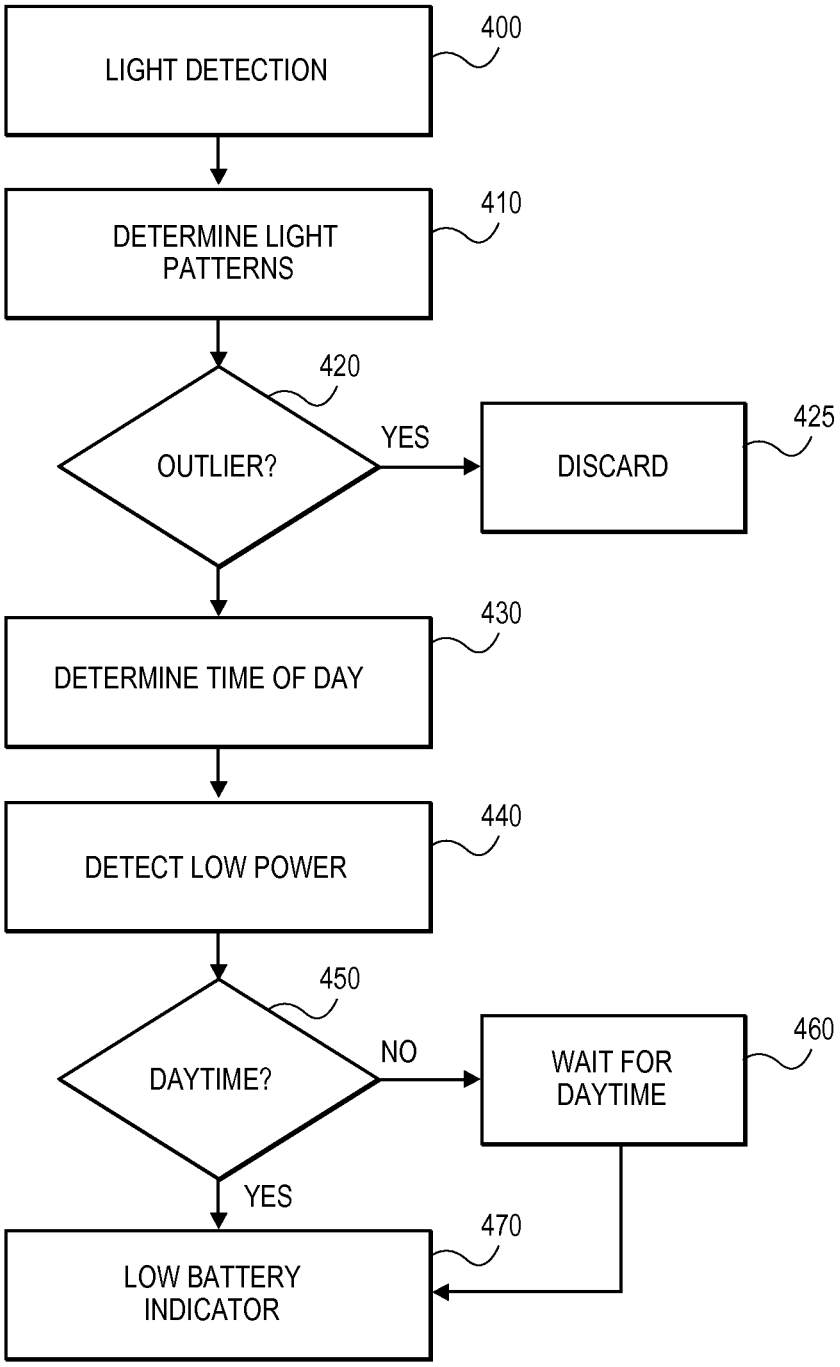
FIG. 4 is a flow diagram depicting an exemplary method for optimizing low battery indication, consistent with certain disclosed embodiments.

Referring to FIG. 4, depicted is a method detailing embodiments as described herein. FIG. 4 depicts steps capable of being performed by an alarm device, such as alarm 110 depicted in FIG. 1B. It should be appreciated that the method of FIG. 4 is merely exemplary and can include more or fewer functionalities.

The method begins when the alarm device detects an amount ambient light in a room using one or more light sensors attached to the alarm device (400). The alarm device can, in certain embodiments, detect the amount of ambient light continuously, while, in other embodiments, the alarm device can detect the amount of light at the end of predetermined time intervals. Based on the amount of ambient light detected, the alarm device can estimate a current time of day.

In some embodiments, the alarm device can record the amount of ambient light and determine a twenty-four (24) hour cycle of ambient light patterns (410). If, at 420, any light detections do not statistically fit with determined ambient light patterns, they can be discarded as outliers (425).

Based on the determined ambient light patterns, the alarm device can estimate a current time of day (430). For example, the alarm device can determine that when an amount of ambient light is low compared to an average amount of light, then the current time of day is likely during nighttime. Accordingly, the alarm device can map a twenty-four (24) hour clock to the ambient light patterns.

The alarm device can then detect that one or more attached batteries are in a low power state (440). The alarm device can use the mapped twenty-four clock to determine the current time of day. If, at 450, the alarm device determines that the current time of day is during daytime hours, the alarm device can initiate a low battery indicator, such as a low battery chirp (470). If, at 450, the alarm device determines that the current time of day is during nighttime hours, the alarm device can wait until daytime hours before initiating the low battery indicator (460).

Figure 5:
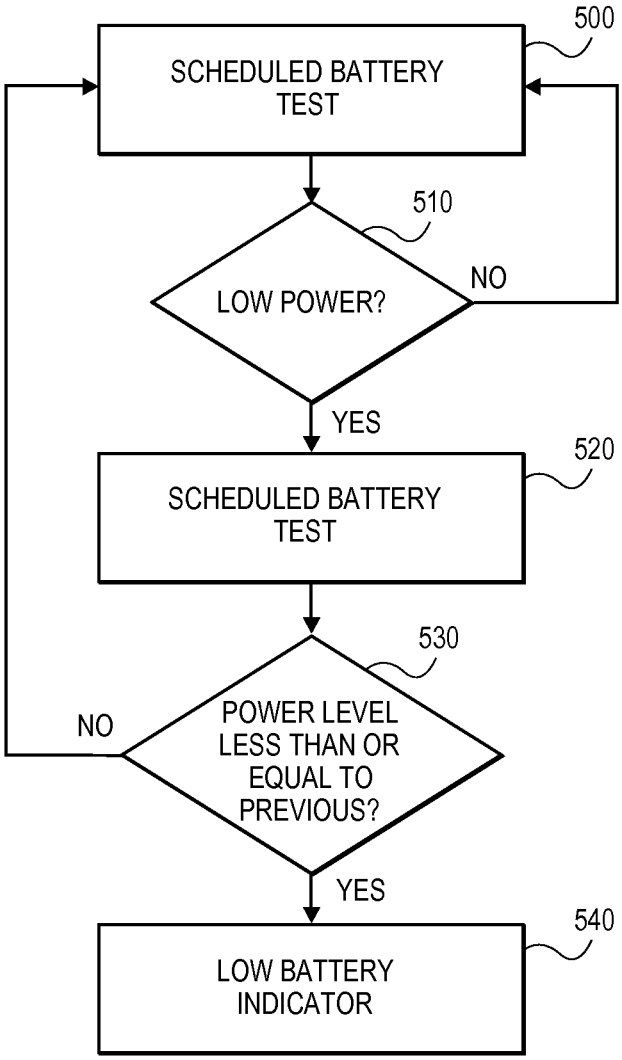
FIG. 5 is a flow diagram depicting an exemplary method for optimizing low battery indication, consistent with certain disclosed embodiments.

Referring to FIG. 5, depicted is a method detailing embodiments as described herein. FIG. 5 depicts steps capable of being performed by an alarm device, such as alarm 110 depicted in FIG. 1B. It should be appreciated that the method of FIG. 5 is merely exemplary and can include more or fewer functionalities.

The method begins when the alarm device performs a regularly scheduled battery check (500). For example, the alarm device can perform a battery check every twelve (12) hours. If, at 510, the alarm device determines that no attached batteries are in a low power state, the alarm device can remain in a normal functioning state and wait until a next scheduled battery check. If, at 510, the alarm device determines that one or more batteries are in a low power state, the alarm device can record power levels of the one or more batteries and wait until a next scheduled battery check.

At the next scheduled battery check, the alarm device can retest power levels of the one or more batteries (520). If, at 530, the alarm device determines that the power levels of the one or more batteries are greater than the power levels determined in 500, the alarm device can return to a normal functioning state. If, at 530, the alarm device determines that one or more batteries have power levels that are less than or equal to the power levels determined in 500, the alarm device can initiate a low battery indicator, such as a low-battery chirp (540).

In further embodiments, the alarm device can perform two or more scheduled battery checks after an initial low power state is detected before initiating a low battery indictor. For example, an alarm device can be configured to perform a battery check every four (4) hours. If, during a regularly scheduled battery check, the alarm device determines that one or more batteries are in a low power state, the alarm device can perform two (2) more battery checks and, if the low power state remains detected, initiate a low battery indicator. If, conversely, the low power state no longer is detected or power levels of the one or more batteries rises above previous levels, the alarm device can return to a normal functioning state.

Figure 6:
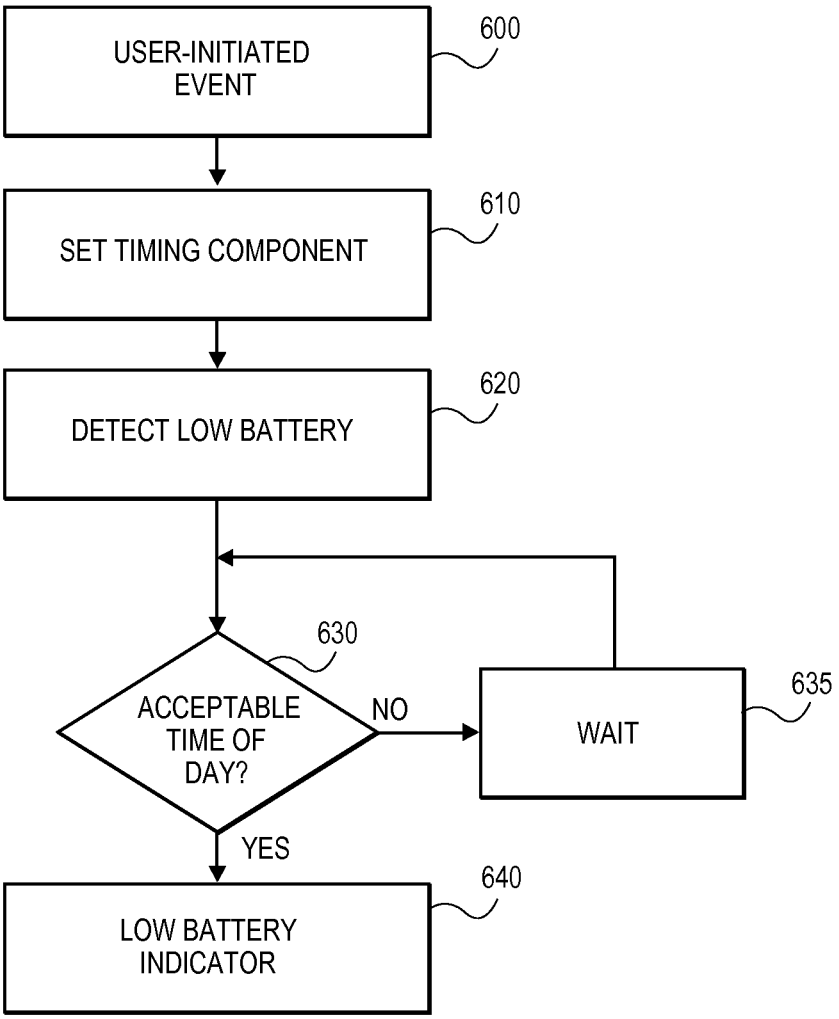
FIG. 6 is a flow diagram depicting an exemplary method for optimizing low battery indication, consistent with certain disclosed embodiments.

Referring to FIG. 6, depicted is a method detailing embodiments as described herein. FIG. 6 depicts steps capable of being performed by an alarm device, such as alarm 110 depicted in FIG. 1B. It should be appreciated that the method of FIG. 6 is merely exemplary and can include more or fewer functionalities.

The method begins when the alarm device detects the occurrence a user-initiated event (600). Such user-initiated events can include, but are not limited to, an installation of the alarm device, a user-initiated test of the alarm device, and a user-initiated powering on of the alarm device.

The alarm device can set a timer or clock based on the user-initiated event (610). For example, the alarm device can set a twenty-four hour clock based on the user-initiated event.

The alarm device can then detect that one or more batteries are in a low power state (620). If, at 630, the alarm device determines that a current time of day is not an acceptable time of day for a low battery indicator, the alarm device can wait until an acceptable time of day (635) before initiating a low battery indicator, such as a low battery chirp (640). For example, the alarm device can determine that the time of day of the user-initiated event is an acceptable time of day for the low battery indicator. Accordingly, the alarm device can use a twenty-four hour clock and wait until a time of day equivalent to that of the user-initiated event before initiating the low battery indicator.

It has been shown how the present embodiments have been attained. Modification and equivalents of the disclosed concepts are intended to be included within the scope of the claims, which are appended hereto.

What is claimed is:

1. An alarm apparatus comprising:
a battery configured to provide at least one of power or backup power to the alarm apparatus;
a timing component;
a sound producing component; and
circuitry containing instructions causing the apparatus to perform operations comprising:
determining that the battery is in a low power state;
initiating a wait state for a predetermined amount of time, using the timing component;
detecting the power level of the battery at regular intervals during the wait state; and
initiating a low battery chirp using the sound producing component based on detecting that the power level of the battery remained in the low power state during the wait state.

2. The apparatus of claim 1, the operations further comprise returning to an initial state based on detecting that the power level of the battery is no longer in the low power state.

3. An alarm apparatus comprising:
a battery configured to provide at least one of power or backup power to the alarm apparatus;
a timing component;
a sound producing component;
a processing system comprising one or more processors; and
a memory system comprising one or more computer-readable media, wherein the computer-readable media contain instructions that, when executed by the processing system, cause the processing system to perform operations comprising:
determining battery voltage levels of the battery at set intervals of a first predetermined period of time;
averaging the battery voltage levels of the battery over a second predetermined period of time;
determining an estimated time of day based a lowest average battery voltage level;
determining that the battery is in a low power state; and
initiating a low battery chirp during the low power state, using the sound producing component, based on a determination that the estimated time of day matches a predetermined time of day.

4. An alarm apparatus comprising:
a battery configured to provide at least one of power or backup power to the alarm apparatus;
a timing component;
a sound producing component;
a light sensor;
a processing system comprising one or more processors; and
a memory system comprising one or more computer-readable media, wherein the computer-readable media contain instructions that, when executed by the processing system, cause the processing system to perform operations comprising:
determining patterns of ambient light using the light sensor;
determining an estimated time of day based the patterns of ambient light;
determining that the battery is in a low power state; and
initiating a low battery chirp during the low power state, using the sound producing component, based on a determination that the estimated time of day matches a predetermined time of day.

5. An alarm apparatus comprising:
a battery configured to provide at least one of power or backup power to the alarm apparatus;
a timing component;
a sound producing component; and
circuitry containing instructions causing the apparatus to perform operations comprising:
determining that the battery is in a low power state at a first time; and
initiating a low battery chirp, using the sound producing component, based on a determination that the battery remained in the low power state at a second subsequent time.

6. The apparatus of claim 5, the operations further comprise clearing the low power state based on a determination that the battery did not remain in the low power state at the second subsequent time.

7. The apparatus of claim 5, wherein the first time and the second subsequent time represent regularly intervened battery power tests performed by the alarm apparatus.

8. The apparatus of claim 5, wherein a time interval between the first time and the second subsequent time is at least twelve hours.

9. An alarm apparatus comprising:
a battery configured to provide at least one of power or backup power to the alarm apparatus;
a timing component;
a sound producing component; and
circuitry containing instructions causing the apparatus to perform operations comprising:
setting an allowed alarm time of day based on an event triggered by a user of the apparatus;
determining that the battery is in a low power state; and
initiating a low battery chirp, using the sound producing component, at the allowed time of day after the low power state was determined.

10. The apparatus of claim 9, wherein the event triggered by the user of the apparatus is an installation of the apparatus.

11. The apparatus of claim 9, wherein the event triggered by the user of the apparatus is powering on of the apparatus.

12. The apparatus of claim 9, wherein the event triggered by the user of the apparatus is a user-initiated test of the apparatus.

* * * * *